US009711845B2

(12) United States Patent
Pinney et al.

(10) Patent No.: US 9,711,845 B2
(45) Date of Patent: Jul. 18, 2017

(54) AERIAL VEHICLE RADOME ASSEMBLY AND METHODS FOR ASSEMBLING THE SAME

(71) Applicant: The Boeing Company, Huntington Beach, CA (US)

(72) Inventors: Thomas Richardson Pinney, Long Beach, CA (US); John C. Waldrop, III, St. Peters, MO (US); John Scott Kruse, Florissant, MO (US)

(73) Assignee: The Boeing Company, Chicago, IL (US)

( * ) Notice: Subject to any disclaimer, the term of this patent is extended or adjusted under 35 U.S.C. 154(b) by 245 days.

(21) Appl. No.: 14/336,866

(22) Filed: Jul. 21, 2014

(65) Prior Publication Data

US 2016/0020512 A1 Jan. 21, 2016

(51) Int. Cl.
*H01Q 1/42* (2006.01)
*H01Q 1/28* (2006.01)

(52) U.S. Cl.
CPC ..... *H01Q 1/42* (2013.01); *H01Q 1/281* (2013.01)

(58) Field of Classification Search
CPC ..... H01Q 1/281; H01Q 1/42
See application file for complete search history.

(56) References Cited

U.S. PATENT DOCUMENTS 4,700,190 A * 10/1987 Harrington ..... H01Q 1/281 342/2
4,875,132 A * 10/1989 Olivenbaum ..... H01Q 1/50 174/2
5,026,033 A * 6/1991 Roxy ..... B23Q 3/103 269/309
5,314,144 A * 5/1994 Porter, Jr. ..... F16B 5/0208 244/119
5,519,958 A * 5/1996 Koretz ..... A01K 97/01 43/17
6,094,054 A * 7/2000 Crist ..... F42B 30/006 102/211
6,975,279 B2 12/2005 Delgado et al.
6,992,640 B2 1/2006 Usami et al.
7,004,666 B2 * 2/2006 Kozlovski ..... H01Q 1/1214 24/289
7,151,504 B1 12/2006 Boatman et al.
8,130,167 B2 * 3/2012 Glabe ..... H01Q 1/42 343/705
2006/0044189 A1 3/2006 Livingston et al.
2007/0228211 A1 * 10/2007 Facciano ..... F42B 10/46 244/3.19
2008/0316140 A1 12/2008 Wu et al.

* cited by examiner

*Primary Examiner* — Trinh Dinh
(74) *Attorney, Agent, or Firm* — Armstrong Teasdale LLP

(57) ABSTRACT

An aerial vehicle includes at least one antenna configured to at least one of transmit and receive a signal and a radome assembly at least partially covering the antenna. The radome assembly includes a shell having an inner surface that defines an opening therein and a tip comprising an extension portion coupled to the shell. The radome assembly also includes a component that engages a portion of the extension portion such that the extension portion is impeded from exiting the opening.

12 Claims, 9 Drawing Sheets

AERIAL VEHICLE RADOME ASSEMBLY AND METHODS FOR ASSEMBLING THE SAME

BACKGROUND

The field of the disclosure relates generally to aerial vehicles, and more specifically, to aerial vehicles including radome assemblies that protect antennas from environmental conditions.

Radomes are structures used to protect antennas (e.g., radar antennas) and associated equipment from environmental exposure. Thus, radomes may be subject to both physical and electromagnetic requirements and specifications. For example, radomes are often used in various types of spacecraft, aircraft, and missiles carrying radar equipment, and as such, must be aerodynamic and capable of withstanding physical and thermal stresses encountered during flight. Radomes also are typically subject to electromagnetic performance requirements and specifications such as, for example, minimum transmission loss, minimum reflected power, minimum beam deflection, and minimum pattern distortion. There is often a trade-off in the design of a radome between physical performance requirements and electromagnetic performance requirements.

Many radomes perform under varying, and often extreme, conditions. For example, at least some known radomes must perform their functions when exposed to high temperatures as may be common for certain aircraft, such as high-speed airplanes, missiles, and spacecraft. More specifically, hypersonic missiles travel through the atmosphere at speeds in the Mach 5-7 range or higher, which may expose missile elements, especially the radome tip, to temperatures of approximately 1700° F. (926° C.) or more for several minutes. Performance of aerial vehicle elements may be limited by such high temperatures. For example, missile radome performance may be limited by temperature, as well as waveband transmittance, material, process maturity, and affordability. Radomes require high temperature capability over sustained periods, all-weather durability, and electrical and/or thermal performance characteristics at a reasonable cost.

BRIEF DESCRIPTION

A radome assembly is provided. The radome assembly includes a shell having an inner surface that defines an opening therein and a tip comprising an extension portion coupled to the shell. The radome assembly also includes a component that engages a portion of the extension portion and the shell inner surface such that the extension portion is impeded from exiting the opening.

An aerial vehicle is provided. The aerial vehicle includes at least one antenna and a radome assembly at least partially covering the antenna. The radome assembly includes a shell having an inner surface that defines an opening therein and a tip comprising an extension portion coupled to the shell. The radome assembly also includes a component that engages a portion of the extension portion such that the extension portion is impeded from exiting the opening.

A method of assembling a radome comprising a shell and a tip is provided. The method includes providing an assembly fixture comprising a tip alignment guide and a shell alignment ring. The radome tip is then positioned into the tip alignment guide and the shell is positioned into the shell alignment ring such that an extension portion of the tip is inserted into an opening defined by an inner surface of the shell. The method also includes coupling a component to the extension portion such that the extension portion is impeded from exiting the opening.

The features, functions, and advantages that have been discussed can be achieved independently in various embodiments or may be combined in yet other embodiments, further details of which can be seen with reference to the following description and drawings.

DETAILED DESCRIPTION

In some implementations, the present invention includes aerial vehicles such as, but not limited to, aircraft and spacecraft, that carry one or more radomes, as described herein. As used herein, the term "aircraft" means and includes any device, apparatus, system, or vehicle designed and constructed for traveling through the air substantially within the Earth's atmosphere. As used herein, the term "spacecraft" means and includes any device, apparatus, system, or vehicle designed and constructed for traveling through space outside the Earth's atmosphere. Aircraft and spacecraft include, for example, airplanes, rockets, missiles, space vehicles, satellites, space stations, etc.

The term "radome" was derived from the terms "radar" and "dome," although, as used herein, the term "radome" includes any structure configured to protect an antenna from environmental exposure and through which electromagnetic radiation is transmitted to or from the antenna. Radomes may have any shape or configuration, and are not limited to dome-shaped structures, and may be configured to transmit any range of frequencies of electromagnetic radiation therethrough.

Figure 1:
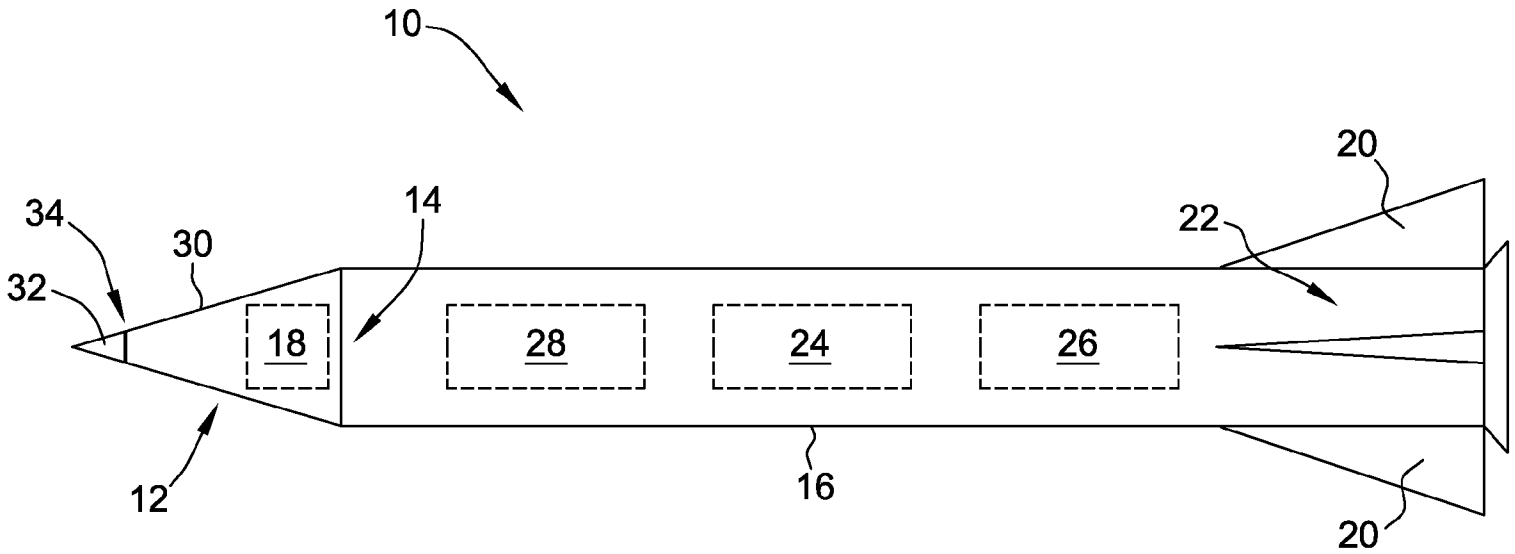
FIG. 1 is a side view of an exemplary aerial vehicle in the form of a missile including an exemplary radome.

FIG. 1 is a side view of an exemplary aerial vehicle 10 including a radome 12. In the exemplary implementation, aerial vehicle 10 is a missile. Alternatively, aerial vehicle 10 may be any type of aerial vehicle as described above.

Radome 12 is coupled to a forward end 14 of a fuselage body 16. Aerial vehicle 10 also includes at least one antenna 18 enclosed within radome 12 on forward end 14. A plurality of fins 20 are coupled at an aft end 22 of fuselage body 16. Although not shown, additional fins, wings, and/or canards may be positioned anywhere along fuselage body 16 for guiding aerial vehicle 10 through the air. Aerial vehicle 10 may be designed and configured to carry a payload 24 to a target destination using a propulsion system 26 and a guidance system 28. Antenna 18 is a component of guidance system 28, and guidance system 28 is configured to control propulsion system 26 in response to guidance information acquired using antenna 18.

In the exemplary implementation, radome 12 is designed, configured, and constructed to protect antenna 18 from environmental conditions (e.g., wind, rain, dust, moisture, heat, etc.) as aerial vehicle 10 travels through the air at a high velocity toward an intended target destination. Radome 12 includes a shell 30 that at least partially circumscribes and covers antenna 18. Radome 12 also includes a tip 32 sized for insertion into an opening (not shown in FIG. 1) in a forward end 34 of radome 12. The opening is a product of the fabrication of shell 30. In the exemplary implementation, shell 30 is fabricated from a ceramic matrix composite (CMC) material configured to withstand high temperatures resulting from high speed air travel. Similarly, tip 32 is also fabricated from a ceramic material. In one embodiment tip 32 is formed from a monolithic ceramic. Alternatively, tip 32 may be formed from the same or different CMC material from which shell 30 is formed.

CMC materials are a subgroup of composite materials as well as a subgroup of technical ceramics. They consist of ceramic fibers embedded in a ceramic matrix, thus forming a ceramic fiber reinforced ceramic (CFRC) material. The matrix and fibers can consist of any ceramic material, whereby carbon and carbon fibers can also be considered a ceramic material. Carbon (C), special silicon carbide (SiC), alumina ($Al_2O_3$) and mullite ($Al_2O_3$-$SiO_2$) fibers are most commonly used for CMC materials. The matrix materials are usually the same, that is C, SiC, alumina and mullite. CMC materials overcome the major disadvantages of conventional technical ceramics, namely brittle failure and low fracture toughness, and limited thermal shock resistance. Therefore, their applications are in fields requiring reliability at high-temperatures (beyond the capability of metals) and resistance to corrosion and wear.

Figure 2:
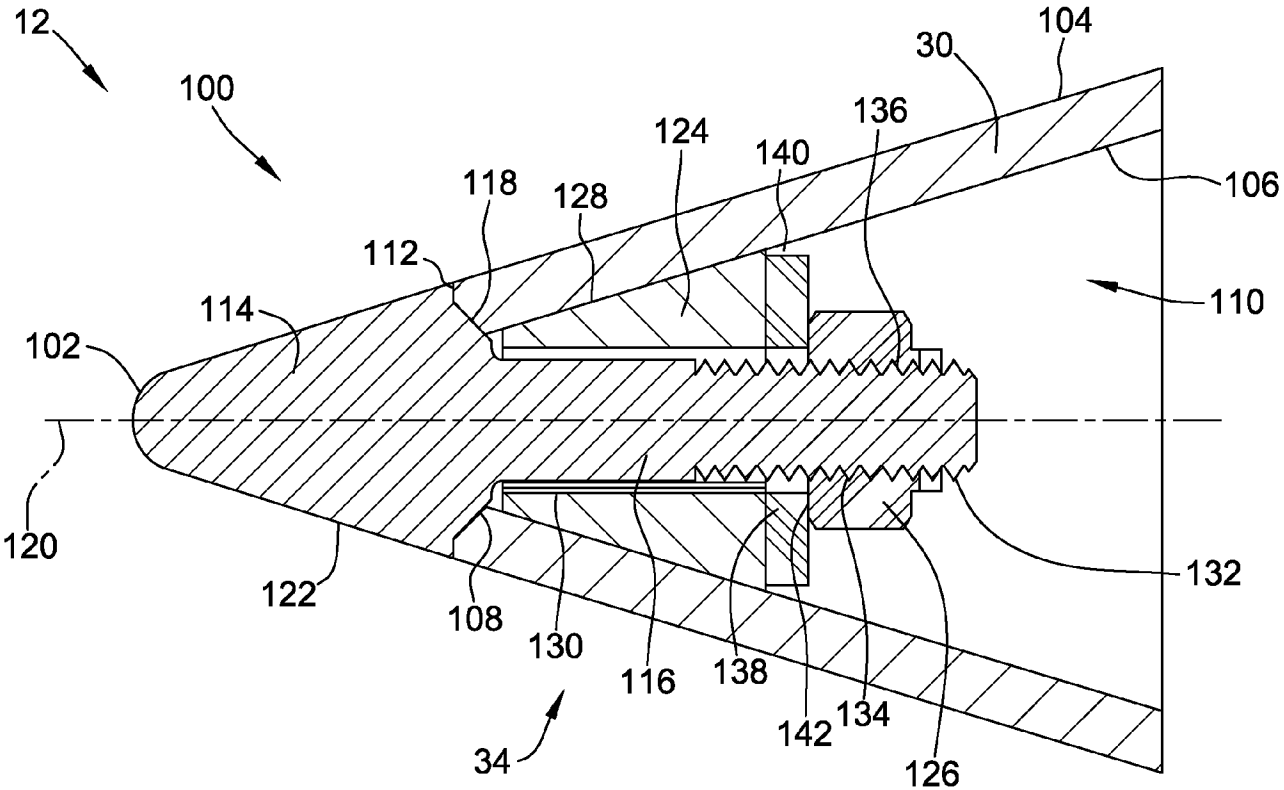
FIG. 2 is a cross-sectional view of a portion of an exemplary radome assembly that may be used with the aerial vehicle shown in FIG. 1.

FIG. 2 is an cross-sectional view of an exemplary radome assembly 100 that may be used with aerial vehicle 10 (shown in FIG. 1). In the exemplary implementation, assembly 100 includes radome shell 30 and a radome tip 102. Shell 30 has a frustoconical shape and includes an outer surface 104 and an inner surface 106 Inner surface 106 defines a shell opening 108 at forward end 34 of shell 30 and an interior 110 of shell 30. Shell 30 also includes a forward surface 112 that extends between inner and outer surfaces 104 and 106 at forward end 34 proximate opening 108. Radome tip 102 includes a tip portion 114 and an extension portion 116 that extends from an aft surface 118 of tip portion 114 in an aft direction. In the exemplary implementation, extension portion 116 of tip 102 has a diameter slightly less than a diameter of shell opening 108 to facilitate inserting extension portion 116 along a longitudinal axis 120 through opening 108 into interior 110 of shell 30. When extension portion 116 is inserted as such, aft surface 118 of tip portion 114 is configured to seat against forward surface 112 of shell 30 such that shell outer surface 104 is substantially flush with an outer surface 122 of tip portion 114. In some embodiments, a sealant and/or adhesive (neither shown) may be applied to at least one of surfaces 112 and 118 to provide additional securement.

In the exemplary implementation, radome assembly 100 also includes a bushing 124 and a fastening nut 126. Bushing 124 has a generally frustoconical shape that is complementary to the adjacent frustoconical shape of shell 30 such that an outer surface 128 of bushing 124 contacts inner surface 106 of shell 30 along substantially an entirety of a length of outer surface 128. In some embodiments, a sealant and/or adhesive (neither shown) may be applied to at least one of surfaces 106 and 128 to provide additional securement. Bushing 124 includes an opening 130 defined therein configured to receive a portion of extension portion 116 therethrough. In the exemplary implementation, opening 130 has a diameter slightly larger than a diameter of extension portion to facilitate slidable engagement of bushing 124 and extension portion 116 such that opening 130 is not threaded. Alternatively, opening 130 may be threaded to engage a plurality of threads 132 formed in extension portion 116. Assembly 100 may include an adhesive material between extension portion 116 and bushing 124 in addition to or in place of threads.

In the exemplary implementation, nut 126 includes an opening 134 defined therein configured to receive a portion of extension portion 116 therethrough. More specifically, opening 134 includes a plurality of threads 136 configured to engage threads 132 of extension portion 116. In some embodiments, assembly 100 may also include a thread locking mechanism or material (not shown) configured to prevent detachment of threads 132 and 136. Assembly 100 may include an adhesive material between extension portion 116 and nut 126 in addition to or in place of threads 132 and 136. In the exemplary implementation, nut 126 is a conventional hex-head nut that is commercially available. Radome assembly 100 may also include at least one washer 138, such as, but not limited to, a spring type Belleville washer, coupled about extension portion 116 between bushing 124 and nut 126.

In the exemplary implementation, tip portion 114 and extension portion 116 are integrally formed from a ceramic material. Furthermore, bushing 124, nut 126, and washer 138 are also formed from a ceramic material that may or may not be the same ceramic material from which tip 102 is formed. Alternatively, at least one of tip 102, bushing 124, nut 126, and washer 138 may comprise a metal or a composite material that exhibits physical properties (e.g., strength, toughness, hardness, etc.) sufficient to withstand the forces and conditions to which they will be exposed during flight of aerial vehicle 10 at the temperatures to which they may be heated during flight of aerial vehicle 10.

In operation, extension portion 116 of tip 102 is inserted through shell opening 108 such that surface 112 and 118 are seated against one another. Subsequently, bushing 124, optional washer 138, and nut 126 are coupled about extension portion 116 within interior 110 of shell 30. In the exemplary implementation, a tool (not shown) is used to rotate nut 126 about axis 120 such that nut 126 applies force in a forward direction to washer 138 and bushing 124. Washer 138 dissipates forces induced to an aft surface 140 of bushing 124 over a larger surface area than is possible using nut 126 alone. Rotation of nut 126 about axis 120 results in a forward force being applied to bushing 124, which facilitates proper alignment of outer surfaces 104 and 122 and prevents tip 102 from exiting shell 30 through opening 108. Furthermore, rotation of nut 126 induces an axial force that forces bushing 124 in a forward direction, which results in inducing a preload force between outer surface 128 of bushing 124 and inner surface 106 of shell 30.

Figure 3:
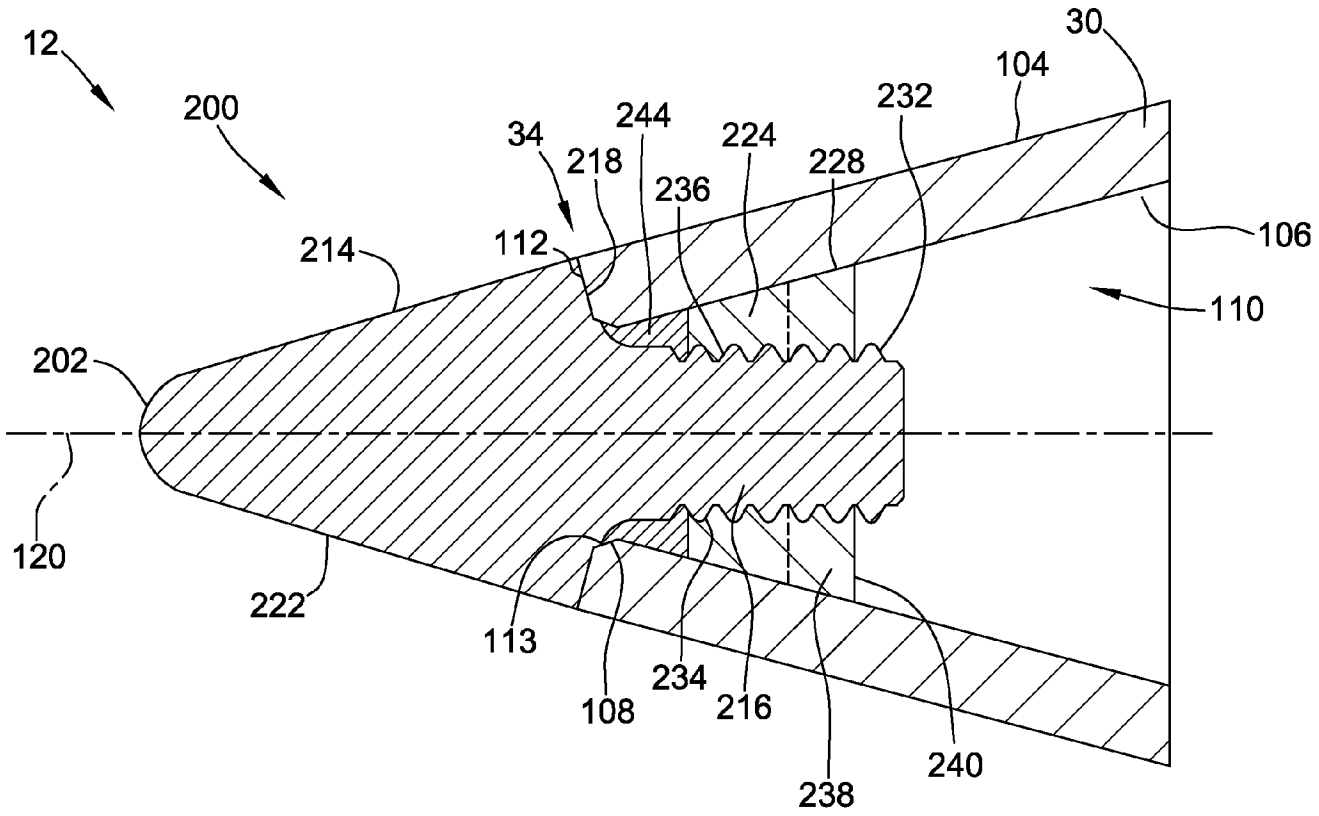
FIG. 3 is a cross-sectional view of an alternative radome assembly that may be used with the aerial vehicle shown in FIG. 1.

FIG. 3 is a cross-sectional view of an alternative radome assembly 200 that may be used with aerial vehicle 10 (shown in FIG. 1). In the exemplary implementation, assembly 200 includes radome shell 30 and a radome tip 202. Shell 30 has a frustoconical shape and includes an outer surface 104 and an inner surface 106 Inner surface 106 defines a shell opening 108 at forward end 34 of shell 30 and an interior 110 of shell 30. Shell 30 also includes a forward surface 112 that extends between inner and outer surfaces 104 and 106 at forward end 34 proximate opening 108. Radome tip 202 includes a tip portion 214 and an extension portion 216 that extends from an aft surface 218 of tip portion 214 in an aft direction. In the exemplary implementation, extension portion 216 of tip 202 has a diameter slightly less than a diameter of shell opening 108 to facilitate inserting extension portion 216 along a longitudinal axis 120 through opening 108 into interior 110 of shell 30. When extension portion 216 is inserted as such, aft surface 218 of tip portion 214 is configured to seat against forward surface 112 of shell 30 such that shell outer surface 104 is substantially flush with an outer surface 222 of tip portion 114. In some embodiments, a sealant and/or adhesive (neither shown) may be applied to at least one of surfaces 112 and 218 to provide additional securement. Furthermore, forward surface 112 may include a chamfered portion 113 proximate opening 108 to avoid interference with a portion of aft surface 218 that is proximate extension portion 216.

In the exemplary implementation, radome assembly 200 also includes a fastening nut 224 having a generally frustoconical shape that is complementary to the adjacent frustoconical shape of shell 30 such that an outer surface 228 of nut 224 contacts inner surface 106 of shell 30 along substantially an entirety of a length of outer surface 228. In some embodiments, a sealant and/or adhesive (neither shown) may be applied to at least one of surfaces 106 and 228 to provide additional securement. Nut 224 includes an opening 234 defined therein configured to receive a portion of extension portion 216 therethrough. More specifically, opening 234 includes a plurality of threads 236 configured to engage a plurality of threads 232 formed on extension portion 216. In some embodiments, assembly 200 may also include a thread locking mechanism or material (not shown) configured to prevent detachment of threads 132 and 236. Nut 224 also includes a groove 238 formed in an aft surface 240 of nut 224 that is configured to be engaged by a tool (not shown) to facilitate rotation of nut 224 about axis 120.

In the exemplary implementation, tip portion 214 and extension portion 216 are integrally formed from a ceramic material. Furthermore, nut 224 is also formed from a ceramic material that may or may not be the same ceramic material from which tip 202 is formed. Alternatively, tip 202 and nut 224 may comprise a metal or a composite material that exhibits physical properties (e.g., strength, toughness, hardness, etc.) sufficient to withstand the forces and conditions to which they will be exposed during flight of aerial vehicle 10 at the temperatures to which they may be heated during flight of aerial vehicle 10.

In operation, extension portion 216 of tip 202 is inserted through shell opening 108 such that surface 112 and 218 are seated against one another. Subsequently, nut 224 is coupled about extension portion 216 within interior 110 of shell 30. In the exemplary implementation, a tool (not shown) is used to rotate nut 224 about axis 120 such that nut 224 pulls tip 202 into a proper alignment as nut 224 moves axially toward opening 108. As such, outer surface 228 of nut 224 induces a preload force on inner surface 106 of shell 30 and tip 202 is prevented from exiting shell 30 through opening 108. In embodiments, where nut 224, tip 202, and shell 30 are made from slightly different ceramic materials, nut 224, tip 202, and shell 30 may have different coefficients of thermal expansion (CTE) that cause one component to expand at a different temperature or a different rate than another component. In such embodiments, radome assembly 200 includes a CTE correction device 244 to maintain the preload force at high temperatures. CTE correction device 244 is positioned axially between tip portion 214 and nut 224 and may be one of a silicone washer (as shown in FIG. 4) or a metal spring element.

Figure 4:
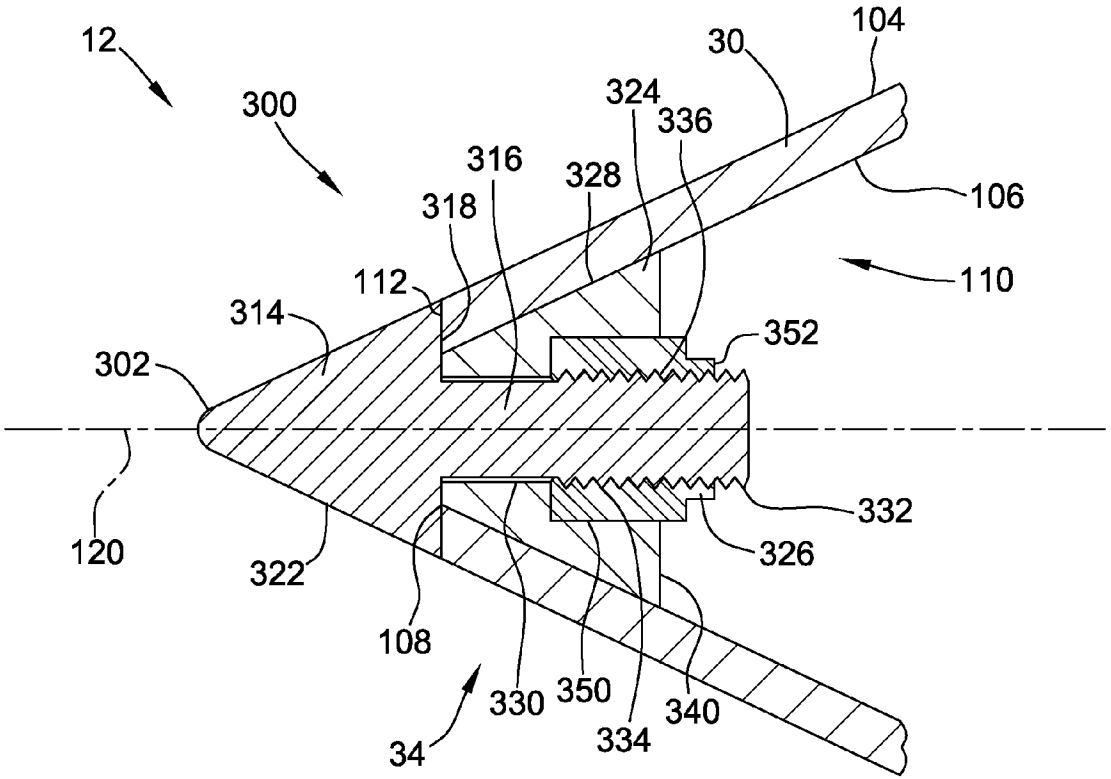
FIG. 4 is a cross-sectional view of another alternative radome assembly that may be used with the aerial vehicle shown in FIG. 1.

FIG. 4 is a cross-sectional view of another alternative radome assembly 300 that may be used with aerial vehicle 10 (shown in FIG. 1). In the exemplary implementation, assembly 300 includes radome shell 30 and a radome tip 302. Shell 30 has a frustoconical shape and includes an outer surface 104 and an inner surface 106 Inner surface 106 defines a shell opening 108 at forward end 34 of shell 30 and an interior 110 of shell 30. Shell 30 also includes a forward surface 112 that extends between inner and outer surfaces 104 and 106 at forward end 34 proximate opening 108. Radome tip 302 includes a tip portion 314 and an extension portion 316 that extends from an aft surface 318 of tip portion 114 in an aft direction. In the exemplary implementation, extension portion 316 of tip 302 has a diameter slightly less than a diameter of shell opening 108 to facilitate inserting extension portion 316 along a longitudinal axis 120 through opening 108 into interior 110 of shell 30. When extension portion 316 is inserted as such, aft surface 318 of tip portion 314 is configured to seat against forward surface 112 of shell 30 such that shell outer surface 104 is substantially flush with an outer surface 322 of tip portion 314. In some embodiments, a sealant and/or adhesive (neither shown) may be applied to at least one of surfaces 112 and 318 to provide additional securement.

In the exemplary implementation, radome assembly 300 also includes a bushing 324 and a fastening nut 326. Bushing 324 has a generally frustoconical shape that is complementary to the adjacent frustoconical shape of shell 30 such that an outer surface 328 of bushing 324 contacts inner surface 106 of shell 30 along substantially an entirety of a length of outer surface 328. In some embodiments, a sealant and/or adhesive (neither shown) may be applied to at least one of surfaces 106 and 328 to provide additional securement. Bushing 324 includes an opening 330 defined through an entire axial length of bushing 324. Opening 330 is configured to receive a portion of extension portion 316 therethrough. In the exemplary implementation, opening 330 has a diameter slightly larger than a diameter of extension portion to facilitate slidable engagement of bushing 324 and extension portion 316 such that opening 330 is not threaded. Alternatively, opening 330 may be threaded to engage a plurality of threads 332 formed in extension portion 316. Furthermore, bushing 324 includes an aft surface 340 having a cavity or a slot 350 defined therein that is sized to receive at least a portion of a fastener, such as, but not limited to nut 326, therein.

In the exemplary implementation, nut 326 includes an opening 334 defined therein configured to receive a portion of extension portion 316 therethrough. More specifically, opening 334 includes a plurality of threads 336 configured to engage threads 332 of extension portion 316. In some embodiments, assembly 300 may also include a thread locking mechanism or material (not shown) configured to prevent detachment of threads 332 and 336. In the exemplary implementation, nut 326 is a conventional hex-head nut that is commercially available.

In the exemplary implementation, tip portion 314 and extension portion 316 are integrally formed from a ceramic material. Furthermore, bushing 324 and nut 326 are also formed from a ceramic material that may or may not be the same ceramic material from which tip 302 is formed. Alternatively, tip 304, bushing 324, and nut 326 may comprise a metal or a composite material that exhibits physical properties (e.g., strength, toughness, hardness, etc.) sufficient to withstand the forces and conditions to which they will be exposed during flight of aerial vehicle 10 at the temperatures to which they may be heated during flight of aerial vehicle 10.

In operation, extension portion 316 of tip 302 is inserted through shell opening 108 such that surface 112 and 318 are seated against one another. Subsequently, bushing 324 and nut 326 are coupled about extension portion 316 within interior 110 of shell 30. In the exemplary implementation, a tool (not shown) is used to rotate nut 326 about axis 120 such that nut 326 is embedded into slot 350. In the exemplary implementation, a portion of nut 326 extends beyond aft surface 340 of bushing 324 such that aft surface 340 is not flush with an aft surface 352 of nut 326. Alternatively, slot 350 may be of a depth such that aft surface 352 of nut 326 is flush with or positioned forward of aft surface 340 of bushing 324. Embedding nut 326 into bushing 324 facilitates reducing the profile of radome assembly 300 that extends into interior 110 of shell 30. As nut 326 is rotated, nut 326 applies force in a forward direction to bushing 324, which facilitates proper alignment of outer surfaces 104 and 322 and prevents tip 302 from exiting shell 30 through opening 108. Furthermore, rotation of nut 326 induces an axial force on bushing 324 that forces bushing 324 in a forward direction, which results in inducing a preload force between outer surface 328 of bushing 324 and inner surface 106 of shell 30.

Figure 5:
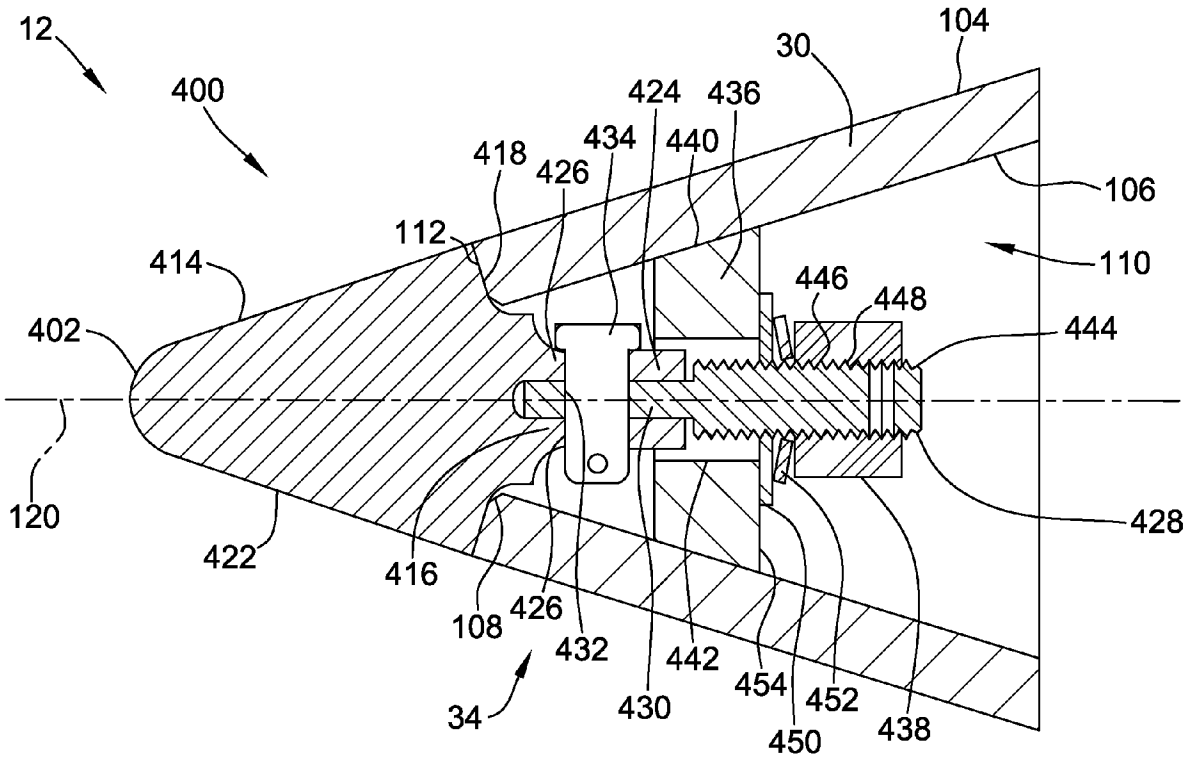
FIG. 5 is an cross-sectional view of yet another alternative radome assembly that may be used with the aerial vehicle shown in FIG. 1.

FIG. 5 is an cross-sectional view of yet another alternative radome assembly 400 that may be used with aerial vehicle 10 (shown in FIG. 1). In the exemplary implementation, assembly 400 includes radome shell 30 and a radome tip 402. Shell 30 has a frustoconical shape and includes an outer surface 104 and an inner surface 106 Inner surface 106 defines a shell opening 108 at forward end 34 of shell 30 and an interior 110 of shell 30. Shell 30 also includes a forward surface 112 that extends between inner and outer surfaces 104 and 106 at forward end 34 proximate opening 108. Radome tip 402 includes a tip portion 414 and an extension portion 416 that extends from an aft surface 418 of tip portion 414 in an aft direction. In the exemplary implementation, extension portion 416 of tip 402 is sized for insertion through shell opening 108 along a longitudinal axis 120 into interior 110 of shell 30. When extension portion 416 is inserted as such, aft surface 418 of tip portion 414 is configured to seat against forward surface 112 of shell 30 such that shell outer surface 104 is substantially flush with an outer surface 422 of tip portion 414. In some embodiments, a sealant and/or adhesive (neither shown) may be applied to at least one of surfaces 112 and 118 to provide additional securement.

In the exemplary implementation, extension portion 416 is formed as a clevis with two opposing arms 424, each having an opening 426 defined therethrough. Furthermore, radome assembly 400 also includes a hanger bolt 428 having a forward end 430 configured for insertion between arms 424 of extension portion 416. Forward end 430 includes an opening 432 defined there that aligns with openings 426 in arms 424 such that a pin 434 may be inserted therethrough to fasten extension portion 416 to bolt 428. Upon assembly of extension portion 416, bolt 428, and pin 434, tip 402 may be inserted through shell opening 108 as described above.

Radome assembly 400 further includes a bushing 436 and a fastening nut 438. Bushing 436 has a generally frustoconical shape that is complementary to the adjacent frustoconical shape of shell 30 such that an outer surface 440 of bushing 436 contacts inner surface 106 of shell 30 along substantially an entirety of a length of outer surface 440. In some embodiments, a sealant and/or adhesive (neither shown) may be applied to at least one of surfaces 106 and 440 to provide additional securement. Bushing 436 includes an opening 442 defined therein configured to receive a portion of extension portion 416 and bolt 428 therethrough. In the exemplary implementation, opening 442 has a diameter slightly larger than a diameter of extension portion 416 and bolt 428 to facilitate slidable engagement of bushing 436 and extension portion 416 and bolt 428 such that opening 442 is not threaded. Alternatively, opening 442 may be threaded to engage a plurality of threads 444 formed in bolt 428.

In the exemplary implementation, nut 438 includes an opening 446 defined therein configured to receive a portion of extension portion 416 therethrough. More specifically, opening 446 includes a plurality of threads 448 configured to engage threads 444 of bolt 428. In some embodiments, assembly 400 may also include a thread locking mechanism or material, such as, but not limited to, a lock wire or a cotter pin (neither shown) configured to prevent detachment of threads 444 and 448. In the exemplary implementation, nut 438 is a conventional nut that is commercially available. Radome assembly 400 may also include at least one washer, such as, but not limited to, a flat washer 450 and a Belleville washer 452, coupled about bolt 428 between bushing 436 and nut 438.

In the exemplary implementation, tip portion 414 and extension portion 416 are integrally formed from a ceramic material. Furthermore, bushing 436 is also formed from a ceramic material that may or may not be the same ceramic material from which tip 102 is formed. Bolt 428, pin 434, nut 438, and washers 450 and 452, on the other hand, are formed from a metallic material that exhibits physical properties (e.g., strength, toughness, hardness, etc.) sufficient to withstand the forces and conditions to which they will be exposed within interior 110 during flight of aerial vehicle 10 at the temperatures to which they may be heated during flight of aerial vehicle 10.

In operation, forward end 430 of bolt 428 is inserted between arms 424 of extension portion 416 such that openings 426 and 432 align. Pin 434 is then inserted therethrough to couple tip 402 to bolt 428. Extension portion 416, bolt 428 and pin 434 are then inserted through shell opening 108 such that surface 112 and 418 are seated against one another. Subsequently, bushing 436, optional washers 450 and 452, and nut 438 are coupled about bolt 428 within interior 110 of shell 30. In the exemplary implementation, a tool (not shown) is used to rotate nut 438 about axis 120 such that nut 438 applies force in a forward direction to washers 450 and 452 and bushing 436. Washers 450 and 452 are configured to disperse forces applied to an aft surface 454 of bushing 436 by nut 438 over a greater surface area than a forward surface of nut 438. Rotation of nut 438 about axis 120 results in a forward force being applied to bushing 436, which facilitates proper alignment of outer surfaces 104 and 422 and prevents tip 402 from exiting shell 30 through opening 108. Furthermore, rotation of nut 438 induces an axial force on bushing 436 that forces bushing 436 in a forward direction, which results in inducing a preload force between outer surface 440 of bushing 436 and inner surface 106 of shell 30. Because nut 438 and bolt 428 are metal, more torque may be applied to each such that a stronger joint is formed and an increased preload force is applied to shell 30.

Figure 6:
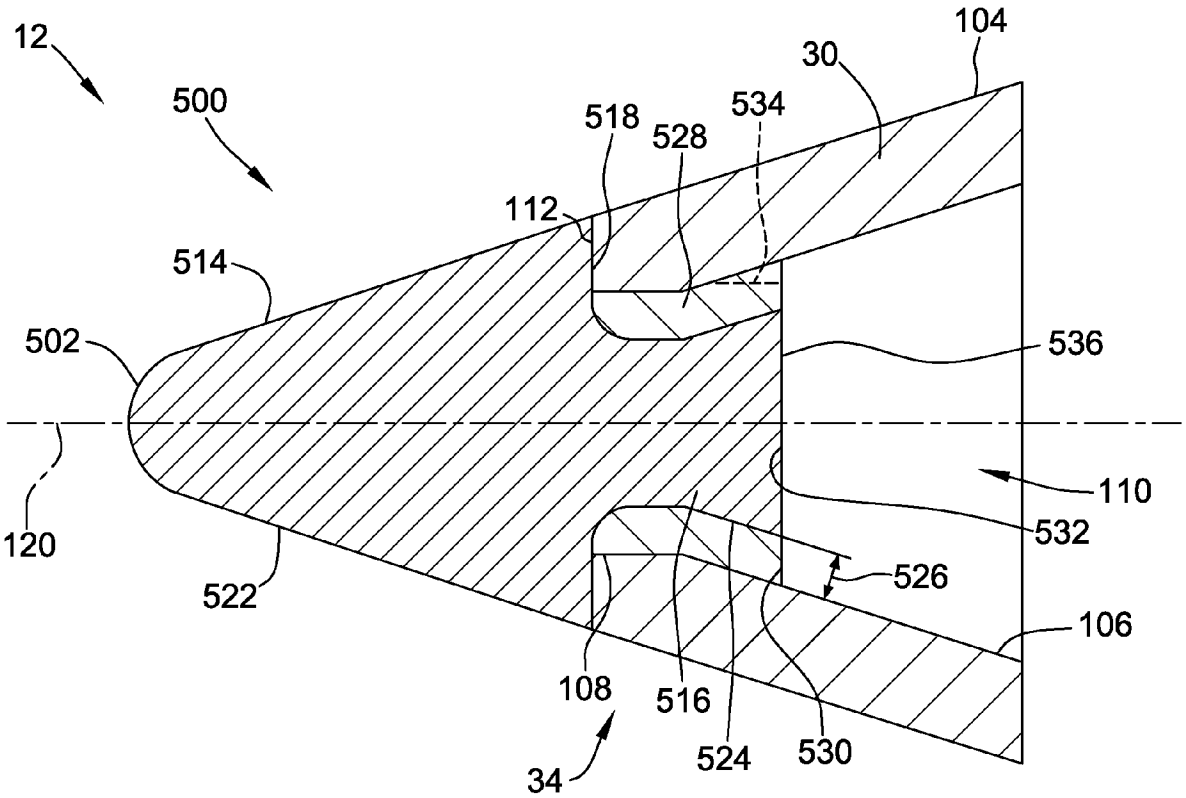
FIG. 6 is a cross-sectional view of another alternative radome assembly that may be used with the aerial vehicle shown in FIG. 1.

FIG. 6 is a cross-sectional view of another alternative radome assembly 500 that may be used with aerial vehicle 10 (shown in FIG. 1). In the exemplary implementation, assembly 500 includes radome shell 30 and a radome tip 502. Shell 30 has a frustoconical shape and includes an outer surface 104 and an inner surface 106 Inner surface 106 defines a shell opening 108 at forward end 34 of shell 30 and an interior 110 of shell 30. Shell 30 also includes a forward surface 112 that extends between inner and outer surfaces 104 and 106 at forward end 34 proximate opening 108. Radome tip 502 includes a tip portion 514 and an extension portion 516 that extends from an aft surface 518 of tip portion 514 in an aft direction. In the exemplary implementation, extension portion 516 of tip 502 is sized for insertion through shell opening 108 along a longitudinal axis 120 into interior 110 of shell 30. When extension portion 516 is inserted as such, aft surface 518 of tip portion 514 is configured to seat against forward surface 112 of shell 30 such that shell outer surface 104 is substantially flush with an outer surface 522 of tip portion 514. In some embodiments, a sealant and/or adhesive (neither shown) may be applied to at least one of surfaces 112 and 518 to provide additional securement.

In the exemplary implementation, extension portion 516 includes an outer surface 524. A substantially constant circumferential gap 526 is defined between outer surface 524 and inner surface 106. Gap 526 is configured to receive a potting material 528 injected therein. As shown in FIG. 6, potting material 528 fills gap 526 such that an aft surface 530 of potting material 528 is substantially flush with an aft surface 532 of extension portion. Alternatively, potting material 528 may cover a portion of aft surface 532, or aft surface 530 of potting material 528 may be positioned forward of aft surface 532 of extension portion 516.

Potting material 528 is a ceramic material configured to bond extension portion 516 to inner surface 106 to maintain the attachment of tip 502 with shell 30. Furthermore, tip portion 514 and extension portion 516 are integrally formed from a ceramic material. The ceramic materials forming tip 502 and potting material 528 are configured to exhibit physical properties (e.g., strength, toughness, hardness, etc.) sufficient to withstand the forces and conditions to which they will be exposed during flight of aerial vehicle 10 at the temperatures to which they may be heated during flight of aerial vehicle 10.

Furthermore, extension portion 516 may include an anti-rotation feature, such as, but not limited to, a notch 534 formed in at least one of outer surface 524 and aft surface 532 of extension portion 516. Potting material 528 substantially fills notch 534 to prevent rotation of top extension portion 516 within potting material 528. In the exemplary implementation, radome assembly 500 may also include a sealant 536 applied to at least one of aft surfaces 530 and 532.

Figure 7:
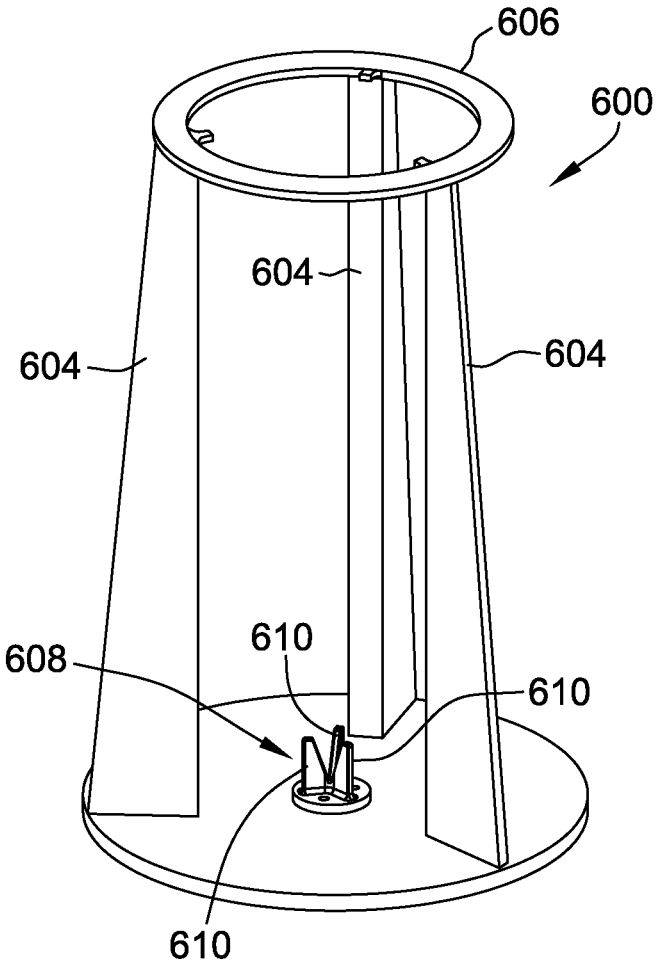
FIG. 7 is a perspective view of an exemplary assembly fixture that may be used to assemble any of the radome assemblies shown in FIGS. 2-6.
Figure 8:
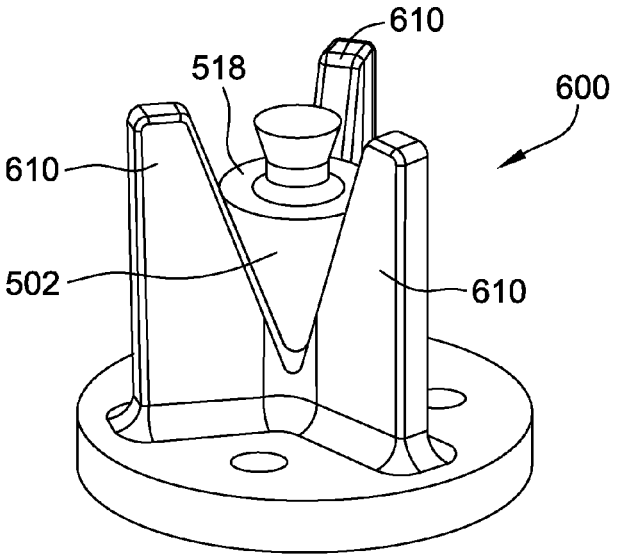
FIG. 8 is a perspective view of an exemplary radome tip portion mounted in the assembly fixture shown in FIG. 7.
Figure 9:
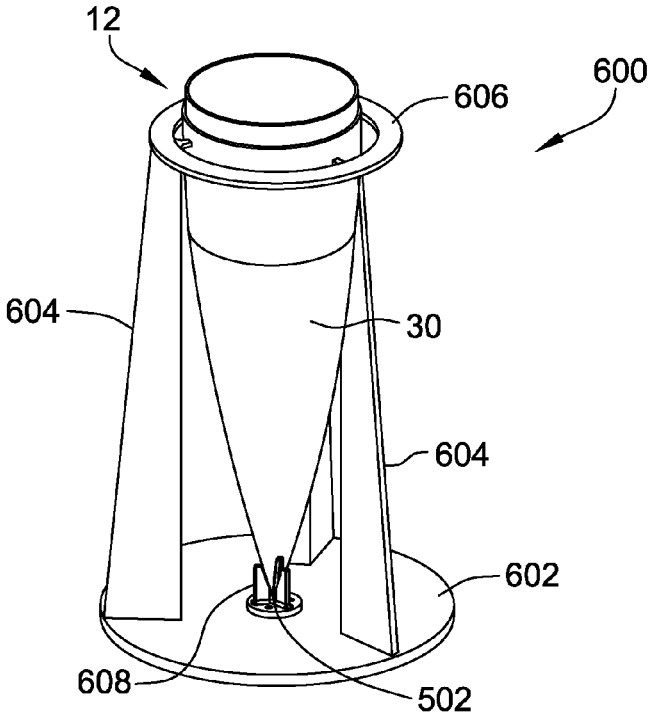
FIG. 9 is a perspective view of any of the radome assemblies shown in FIGS. 2-6 mounted in the assembly fixture shown in FIG. 7.
Figure 10:
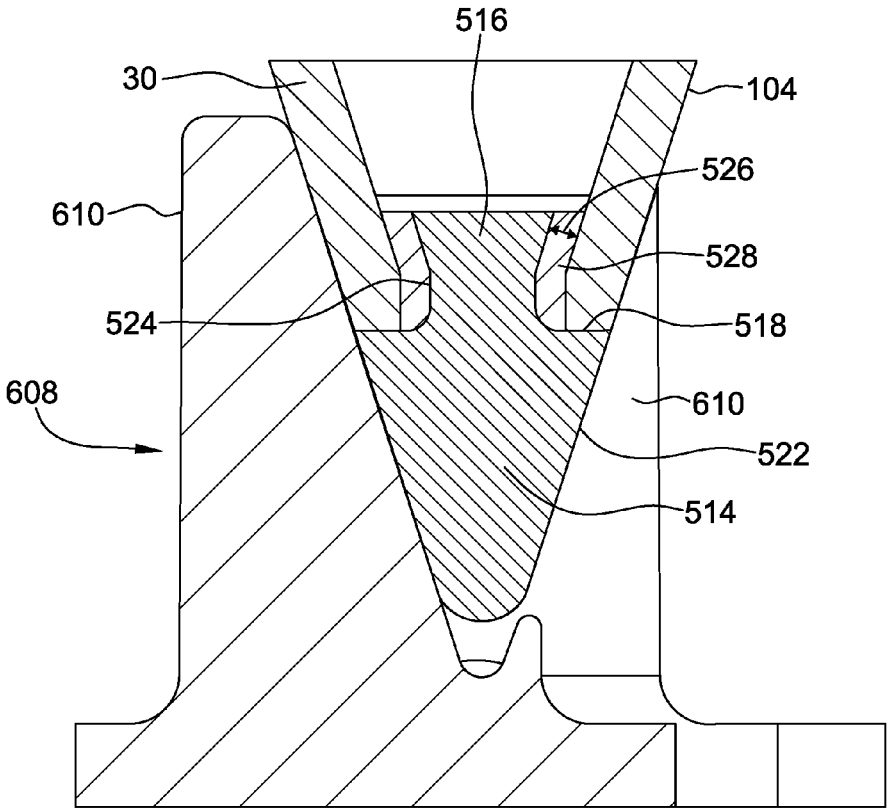
FIG. 10 is a cross-sectional view of the radome assembly shown in FIG. 9 mounted in the assembly fixture shown in FIG. 7.

FIG. 7 is a perspective view of an assembly fixture 600 that may be used to assemble any of radome assemblies 100, 200, 300, 400, and 500 shown in FIGS. 2-6. While the use of assembly fixture 600 is shown and described in FIGS. 8-10 using radome assembly 500, assembly fixture 600 may be used to assembly any of radome assemblies 200, 300, 400, and 500. FIG. 8 is a perspective view of radome tip 502 mounted in assembly fixture 600. FIG. 9 is a perspective view of radome assembly 500 mounted in assembly fixture 600. FIG. 10 is a cross-sectional view of radome assembly 500 mounted in the assembly fixture 600.

In the exemplary implementation, assembly fixture 600 includes a baseplate 602 and a plurality of arms 604 extending from baseplate 602. A shell alignment ring 606 is coupled at a distal end of each of arms 604. Assembly fixture 600 also includes a tip alignment guide 608 coupled to baseplate 602. Tip alignment guide 608 includes a plurality of alignment supports 610 configured to receive tip 502. Shell 30 is then inserted through alignment ring 606 and coupled to tip 502 to facilitate mating surfaces 112 and 518, as described above. Alignment supports 610 each extend beyond aft surface 518 of tip portion 514 such that each support 610 contacts outer surfaces 522 and 104 of tip 502 and shell 30, respectively. As such, alignment supports 610 facilitate aligning tip 502 and shell 30 such that outer surfaces 522 and 104 are substantially flush. Alternatively, alignment supports 610 may not contact surface 104, is which case at least one feller gauge (not shown) is utilized between supports 610 and surface 104 to center tip 502. In the exemplary implementation, once surfaces 112 and 518 have mated, potting material 528 is then injected into gap 526 defined between outer surface 524 of extension portion 516 and inner surface 106 of shell 30. Potting material 528 then undergoes a curing process to bond tip 502 to shell 30.

As described above, the steps shown in FIGS. 8-10 may be completed with any other of radome assemblies 100, 200, 300, and 400. Once shell 30 is positioned in assembly fixture 600, the bushings, nuts, and washers described as components of radome assemblies 100, 200, 300, and 400 may then be coupled to their respective extension portions to couple shell 30 to respective tips.

The embodiments described herein provide radome assemblies that enable coupling of a ceramic radome tip to a CMC radome shell to form a radome for an aerial vehicle. The embodiments described herein include few, if any, metal components, and, as such, do not interfere with signals received by, or transmitted from, the antenna within the radome, thus leading to improved electromagnetic performance of the radome. Furthermore, the embodiments described herein include a relatively low forward facing profile that further improves electromagnetic performance of the radome. Additionally, each radome assembly described herein induces a component coupled to the tip portion that induces a radial preload force to the outer radome shell to retain the tip portion within the shell and to ensure proper alignment of the shell and the tip portion. The radome assemblies described herein include relative few components making for a simpler and less expensive manufacturing and assembly process.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose various embodiments, which include the best mode, to enable any person skilled in the art to practice those embodiments, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A radome assembly comprising:

a shell having an inner surface that defines an opening;

a tip comprising an extension portion coupled to the shell;

a component engaging a portion of the extension portion and the shell inner surface such that the extension portion is impeded from exiting the opening, wherein said component comprises a bushing having a frustoconical outer surface configured to induce a radial preload force between said tip to said shell, and having an aft surface and a slot formed in the aft surface; and a fastener threadably coupled to said extension portion to secure the component, wherein the slot is sized to receive at least a portion of the fastener.

2. The radome assembly in accordance with claim 1 wherein said fastener is configured to induce an axial force to said component as a radial preload force between said tip to said shell.

3. The radome assembly in accordance with claim 2, wherein said fastener is formed from a ceramic material.

4. The radome assembly in accordance with claim 1 further comprising at least one washer coupled about said extension portion.

5. The radome assembly in accordance with claim 1, wherein said component includes a coefficient of thermal expansion correction device configured to maintain a preload force at high temperatures.

6. An aerial vehicle comprising;

at least one antenna and a radome assembly at least partially covering said antenna, said radome assembly comprising:

a shell having an inner surface that defines an opening;

a tip comprising an extension portion coupled to the shell;

a component that engages a portion of the extension portion such that the extension portion is impeded from exiting the opening; and a fastener threadably coupled to said extension portion to secure the component, wherein the fastener includes a frustoconical outer surface configured to induce a radial preload force between the tip to the shell.

7. The radome assembly in accordance with claim 6, wherein said tip and said component are formed from a ceramic material.

8. The radome assembly in accordance with claim 6, wherein said component includes a coefficient of thermal expansion correction device configured to maintain a preload force at high temperatures.

9. A method of assembling an aerial vehicle that includes at least one antenna and a radome comprising a shell and a tip, said method comprising:

at least partially covering the at least one antenna with the radome;

providing an assembly fixture comprising a tip alignment guide and a shell alignment ring;

positioning the tip into the tip alignment guide;

positioning the shell into the shell alignment ring such that a tip extension portion is inserted into an opening defined by a shell inner surface;

coupling a component to the extension portion and to the shell inner surface such that the extension portion is impeded from exiting the opening; and threadably coupling a fastener to the extension portion such that a frustoconical outer surface of the fastener induces a radial preload force between the tip to the shell to secure the component.

10. The method in accordance with claim 9, wherein positioning the shell into the alignment ring comprises positioning the shell into the alignment ring such that an outer surface of the tip and an outer surface of the shell are substantially flush.

11. The method in accordance with claim 9, wherein coupling at least one component to the tip comprises injecting a potting material between the tip extension portion and the shell inner surface to facilitate coupling the tip to the shell.

12. The method in accordance with claim 9, wherein coupling at least one component to the tip comprises coupling a bushing having a frustoconical outer surface to the extension portion, wherein the frustoconical outer surface is configured to induce a radial preload force between the tip to the shell.

* * * * *